US008769843B2

(12) United States Patent
Cook et al.

(10) Patent No.: US 8,769,843 B2
(45) Date of Patent: Jul. 8, 2014

(54) ARTICLE OF FOOTWEAR WITH TWO PART MIDSOLE ASSEMBLY

(75) Inventors: Christopher S. Cook, Portland, OR (US); Bryan N. Farris, North Plains, OR (US); Ernest E. Kim, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 149 days.

(21) Appl. No.: 13/493,589

(22) Filed: Jun. 11, 2012

(65) Prior Publication Data

US 2012/0260528 A1 Oct. 18, 2012

Related U.S. Application Data

(63) Continuation of application No. 12/359,553, filed on Jan. 26, 2009, now Pat. No. 8,196,316.

(51) Int. Cl.
*A43B 13/12* (2006.01)
*A43B 13/18* (2006.01)

(52) U.S. Cl.
USPC ..... 36/30 R; 36/28; 36/102

(58) Field of Classification Search
USPC ..... 36/30 R, 28, 102, 25 R, 31, 32 R
See application file for complete search history.

(56) References Cited

U.S. PATENT DOCUMENTS 4,399,620 A * 8/1983 Funck ..... 36/30 R
5,595,002 A 1/1997 Slepian et al.
6,061,929 A * 5/2000 Ritter ..... 36/107
6,725,572 B1 * 4/2004 Krstic ..... 36/25 R
7,600,332 B2 * 10/2009 Lafortune ..... 36/43
8,196,316 B2 * 6/2012 Cook et al. ..... 36/30 R
2009/0019729 A1 * 1/2009 Nakano et al. ..... 36/91
2009/0313856 A1 * 12/2009 Arizumi ..... 36/102

FOREIGN PATENT DOCUMENTS

WO WO9905928 * 2/1999

OTHER PUBLICATIONS

First Office Action, issued May 15, 2013, in corresponding Chinese Patent Application No. 201080004859.X.

* cited by examiner

*Primary Examiner* — Ted Kavanaugh
(74) *Attorney, Agent, or Firm* — Banner & Witcoff, Ltd.

(57) ABSTRACT

An article of footwear includes an upper and a sole assembly secured to the upper. The sole assembly has a shell having a first hardness and a recess. A lateral side of the recess has a first depth and a medial side of the recess has a second depth that is different than the first depth. A first aperture extends through a forefoot portion of the shell, with the first aperture defining a first tongue fixed on a medial side thereof with a remainder of the first tongue free to flex with respect to the shell. An insert has a second hardness and is seated in the recess. A lateral side of the insert has a first height and a medial side of the insert has a second height that is different than the first height, with the second hardness being different than the first hardness.

15 Claims, 3 Drawing Sheets

ARTICLE OF FOOTWEAR WITH TWO PART MIDSOLE ASSEMBLY

RELATED APPLICATIONS

This application is a continuation application of U.S. application Ser. No. 12/359,553, filed on Jan. 26, 2009, which is incorporated herein by reference in its entirety

FIELD OF THE INVENTION

Aspects of this invention relate generally to an article of footwear with a two-part midsole, and, in particular, to an article of footwear with a midsole having a shell and an insert received in a recess in the shell.

BACKGROUND OF THE INVENTION

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide fraction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethyl vinyl acetate (EVA), that extends throughout the length of the footwear, often by way of an injection molding process. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide a midsole with an insert that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a midsole with an insert. In accordance with a first aspect, an article of footwear includes an upper and a sole assembly secured to the upper. The sole assembly has a shell having a first hardness and a recess. A lateral side of the recess has a first depth and a medial side of the recess has a second depth that is different than the first depth. A first aperture extends through a forefoot portion of the shell, with the first aperture defining a first tongue fixed on a medial side thereof with a remainder of the first tongue free to flex with respect to the shell. An insert has a second hardness and is seated in the recess. A lateral side of the insert has a first height and a medial side of the insert has a second height that is different than the first height. The second hardness of the insert is different than the first hardness of the shell.

In accordance with another aspect, an article of footwear includes an upper and a sole assembly secured to the upper. The sole assembly includes a shell having a first hardness and a recess formed therein. A lateral side of the recess has a first depth and a medial side of the recess has a second depth that is different than the first depth. A first aperture extends through a forefoot portion of the shell. The first aperture defines a first tongue fixed on a medial side thereof with a remainder of the first tongue free to flex with respect to the shell. The first tongue is positioned to be beneath a first metatarsal head of a user's foot. A second aperture extends through a midfoot portion of the shell. The second aperture defines a second tongue fixed on a lateral side thereof with a remainder of the second tongue free to flex with respect to the shell. The second tongue is positioned to be beneath a cuboid bone of a user's foot. An insert has a second hardness and is seated in the recess. A lateral side of the insert has a first height and a medial side of the insert has a second height that is different than the first height. The second hardness of the insert is different than the first hardness of the shell.

In accordance with a further aspect, an article of footwear includes an upper and a sole assembly secured to the upper. The sole assembly includes a shell formed of EVA and having a first hardness and a recess formed therein. A lateral side of the recess has a first depth and a medial side of the recess has a second depth that is different than the first depth. A first aperture extends through a forefoot portion of the shell, and the first aperture defines a first tongue fixed on a medial side thereof with a remainder of the first tongue free to flex with respect to the shell. A second aperture extends through a midfoot portion of the shell and defines a second tongue fixed on a lateral side thereof with a remainder of the second tongue free to flex with respect to the shell. An insert is formed of EVA and has a second hardness, and is secured within the recess with adhesive. A lateral side of the insert has a first height and a medial side of the insert has a second height that is different than the first height. The second hardness of the insert is different than the first hardness of the shell.

Substantial advantage is achieved by providing an article of footwear with a two-part midsole. In particular with certain embodiments, for a user whose foot tends to pronate, the increased support on the medial side of the midsole and increased compression on a lateral side of the midsole helps to reduce the tendency of the user's foot to pronate. For a user whose foot does not tend to pronate, the improved structure of the footwear does not come into effect. Other embodiments provide increased flexibility in forefoot and midfoot portions of the article of footwear, while still providing support for the first metatarsal head and the cuboid bone of the user's foot.

These and additional features and advantages disclosed here will be further understood from the following detailed disclosure of certain embodiments.

Figure 1:
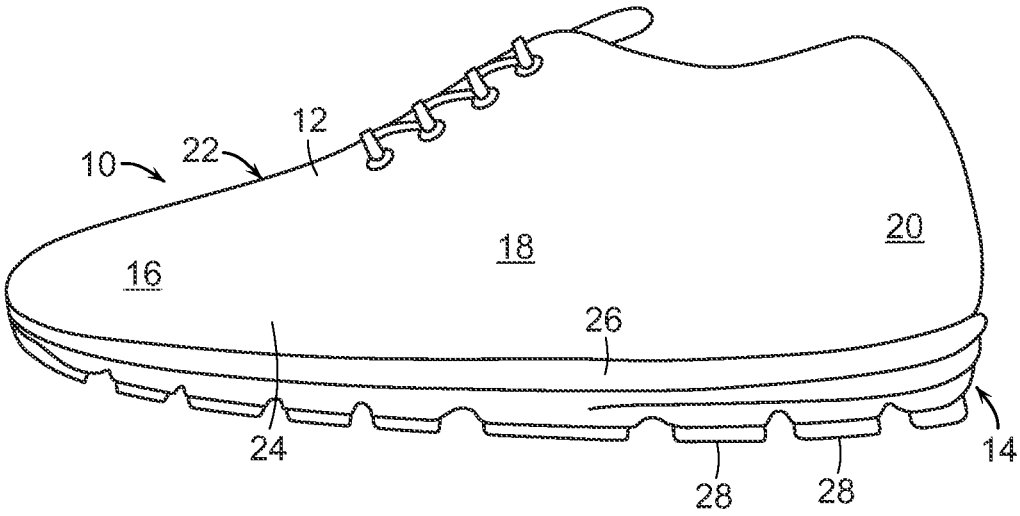
FIG. 1 is an elevation view of an article of footwear with a two-part midsole.

The figures referred to above are not drawn necessarily to scale, should be understood to provide a representation of particular embodiments of the invention, and are merely conceptual in nature and illustrative of the principles involved. Some features of the article of footwear with a two-part midsole depicted in the drawings have been enlarged or distorted relative to others to facilitate explanation and understanding. The same reference numbers are used in the drawings for similar or identical components and features shown in various alternative embodiments. Articles of footwear with two-part midsoles as disclosed herein would have configurations and components determined, in part, by the intended application and environment in which they are used.

DETAILED DESCRIPTION OF CERTAIN PREFERRED EMBODIMENTS

The following discussion and accompanying figures disclose various embodiments of a sole structure for an article of footwear. The sole structure may be applied to a wide range of athletic footwear styles, including tennis shoes, football shoes, cross-training shoes, walking shoes, soccer shoes, and hiking boots, for example. The sole structure may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

An article of footwear 10 is depicted in FIG. 1 as including an upper 12 and a sole assembly 14. For reference purposes, footwear 10 may be divided into three general portions: a forefoot portion 16, a midfoot portion 18, and a heel portion 20, as shown in FIG. 1. Footwear 10 also includes a lateral side 22 and a medial side 24. Forefoot portion 16 generally includes portions of footwear 10 corresponding with the toes and the joints connecting the metatarsals with the phalanges. Midfoot portion 18 generally includes portions of footwear 10 corresponding with the arch area of the foot, and heel portion 20 corresponds with rear portions of the foot, including the calcaneus bone. Lateral side 22 and medial side 24 extend through each of portions 16-20 and correspond with opposite sides of footwear 10.

Portions 16-20 and sides 22-24 are not intended to demarcate precise areas of footwear 10. Rather, portions 16-20 and sides 22-24 are intended to represent general areas of footwear 10 to aid in the following discussion. In addition to footwear 10, portions 16-20 and sides 22-24 may also be applied to upper 12, sole assembly 14, and individual elements thereof.

The figures illustrate only an article of footwear intended for use on the left foot of a wearer. One skilled in the art will recognize that an article of footwear for the right foot of a wearer, such article being the mirror image of the left, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Upper 12 forms an interior void that comfortably receives a foot and secures the position of the foot relative to sole assembly 14. The configuration of upper 12, as depicted, is suitable for use during athletic activities that involve running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Sole assembly 14 may be secured to upper 12 by an adhesive, or any other suitable fastening means. Sole assembly 14, which is generally disposed between the foot of the wearer and the ground, provides attenuation of ground reaction forces (i.e., imparting cushioning), fraction, and may control foot motions, such as pronation. As with conventional articles of footwear, sole assembly 14 includes an insole (not shown) located within upper 12, a midsole 26, and an outsole 28. Outsole 28 may be a contiguous single piece of material, or it may be formed of a plurality of individual pieces secured to midsole 26.

Midsole 26 is attached to upper 12 and functions as the primary shock-attenuating and energy-absorbing component of footwear 10. Outsole 28 is attached to the lower surface of midsole 26 by adhesive or other suitable means. Suitable materials for outsole 28 include traditional rubber materials. Other suitable materials for outsole 28 will become readily apparent to those skilled in the art, given the benefit of this disclosure. In certain embodiments, sole assembly 14 may not include an outsole layer separate from midsole 26 but, rather, the outsole may comprise a bottom surface of midsole 26 that provides the external traction surface of sole assembly 14.

Figure 2:
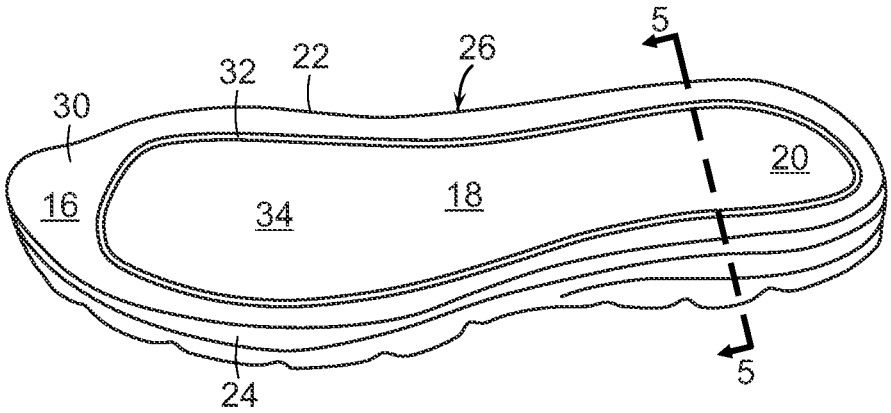
FIG. 2 is a perspective view of the two-part midsole of the article of footwear of FIG. 1.
Figure 3:
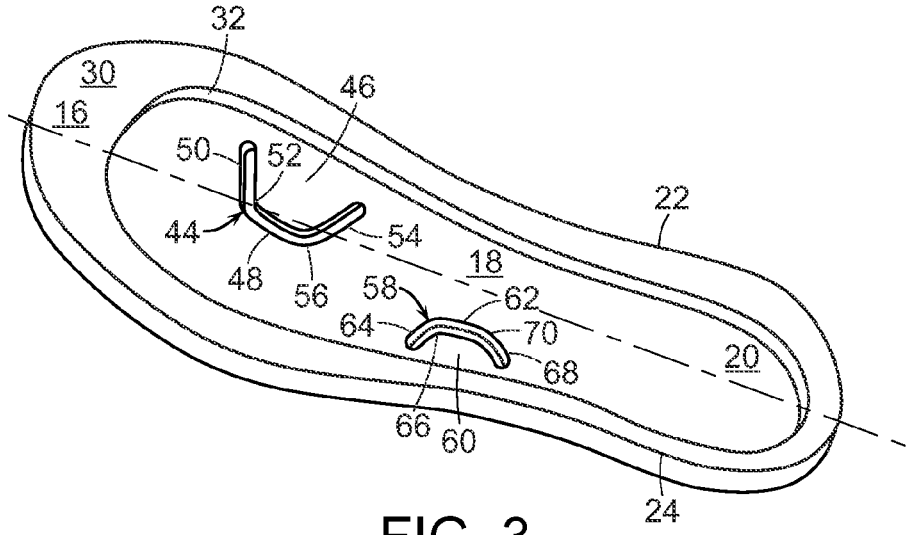
FIG. 3 is a perspective view of a shell of the two-part midsole of FIG. 2.
Figure 4:
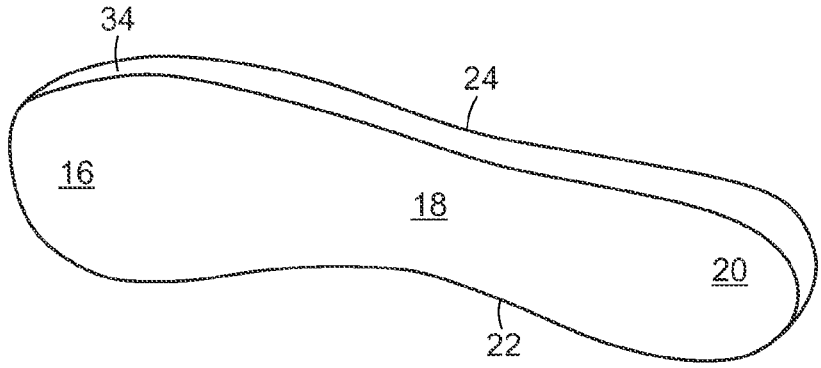
FIG. 4 is a perspective view of an insert of the two-part midsole of FIG. 2.

As seen more clearly in FIGS. 2-4, certain embodiments of midsole 26 include a first portion or shell 30 having a central recess 32 formed therein. In the illustrated embodiment, recess 32 extends laterally across midsole 26 from a point proximate medial side 22 to a point proximate lateral side 24, and longitudinally along midsole 26 from a point proximate a rear edge of heel portion 20 of midsole 26 to a central point in forefoot portion 16 of midsole 26. A second portion or insert 34 of midsole 26 is received in recess 32.

The depth of recess 32 is different on lateral side 24 than it is on medial side 22. As seen in the embodiment illustrated in FIG. 5, recess 32 has a depth A on its lateral side 24 and a depth B on its medial side 22, with depth B being less than depth A. Correspondingly, insert 34 has a height C on its lateral side 24 and a height D on its medial side that are different than one another, with height D being less than height C in the embodiment illustrated in FIG. 5. As can be seen here, a lower surface 36 of recess 32, and a lower surface 38 of insert 34, extend at an angle $\alpha$ with respect to a lower surface 40 of shell 30.

Figure 5:
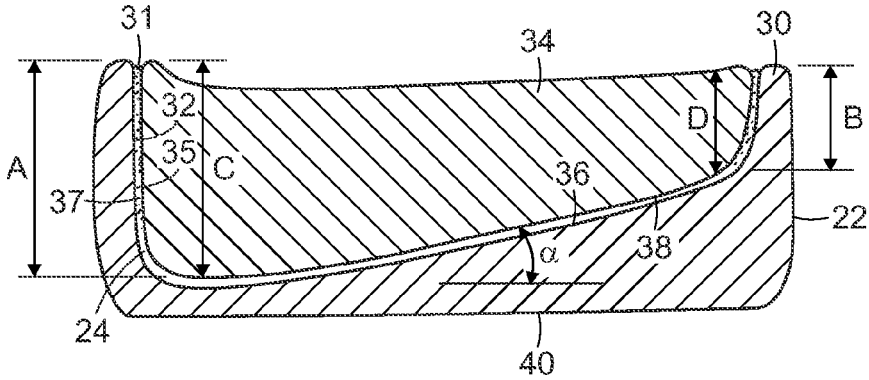
FIG. 5 is a section view of the two-part midsole of FIG. 2, taken along line 5-5 of FIG. 2.

Insert 34 may be secured to shell 30 within recess 32 with an adhesive 31, as seen in FIG. 5. In certain embodiments, adhesive 31 is applied only along a sidewall 35 of shell 30 and along an outer periphery 37 of insert 34, leaving lower surface 38 of insert 34 free to move with respect to lower surface 36 of recess 32. In other embodiments, adhesive 31 may be applied along all or much of the exterior of insert 34 and recess 32. Suitable adhesives include any of the conventional adhesives known in the art, and suitable adhesives will become readily apparent to those skilled in the art, given the benefit of this disclosure.

Shell 30 has a first hardness, and insert 34 has a second hardness that is different than the first hardness. In the embodiment illustrated in FIG. 5, the second hardness is lower than the first hardness. Thus, insert 34 is softer and compresses more than does shell 30. Since insert 34 is thicker on its lateral side 24 and shell 30 is thinner beneath the lateral side 24 of insert 34, and insert 34 is thinner on its medial side 22 and shell 30 is thicker beneath medial side 22 of insert 34, the lateral side 24 of midsole 26 will compress more than its medial side 22 when midsole 26 is compressed by a user's foot. Accordingly, the user's foot is forced to the lateral side 24 of midsole 26 when compressing midsole 26. Thus, the difference in thickness of insert 34 and the difference in the height of recess 32 cooperate to cause midsole 26 to act as a wedge, with more support being provided on medial side 22, thereby helping to reduce pronation.

In certain embodiments, shell 30 has a hardness of between approximately 50 and 70 Asker C, and more preferably between approximately 56 and 58 Asker C. Insert 34 may have a hardness of between approximately 30 Asker C and 60 Asker C, and more preferably approximately 50 Asker C.

By varying the difference between the hardness of shell 30 and that of insert 34, the extent to which lateral side 24 of midsole 26 compresses more easily than that of medial side 22 can be adjusted or tuned. Similarly, by varying the angle $\alpha$, the extent to which lateral side 24 of midsole 26 compresses more easily than that of medial side 22 can be adjusted or tuned.

In certain embodiments, shell 30 and insert 34 are formed of the same type of material, but with different hardnesses. In other embodiments, shell 30 and insert 34 may be formed of different materials.

In certain embodiments, shell 30 and insert 34 are formed of Ethylene Vinyl Acetate ("EVA" or "phylon") foam. Shell 30 may be formed of injected EVA and insert 34 may be formed of compression molded EVA. In other embodiments, shell 30 may be formed of compression molded EVA and insert 34 may be formed of injected EVA. In certain other embodiments, both shell 30 and insert 34 could be formed of injected EVA and formed in the same mold.

In other embodiments, shell 30 and/or insert 34 may be formed of polyurethane; or a mixture of a hydrogenated or non-hydrogenated acrylonitrile-butadiene copolymer, a modified hydrogenated acrylonitrile-butadiene copolymer, and an alpha olefin copolymer. Other exemplary materials used to make shell 30 and insert 34 are described in U.S. application Ser. No. 11,752,348, entitled "Article of Footwear with Lightweight Sole Assembly," filed on May 23, 2007, the entire disclosure of which is incorporated herein be reference for all purposes.

Other suitable materials for shell 30 and insert 34 will become readily apparent to those skilled in the art, given the benefit of this disclosure.

In certain embodiments, a first aperture 44 is formed in and extends through a metatarsal area of forefoot portion 16 of shell 30 of midsole 26. First aperture 44 defines a first forefoot flap or tongue 46 fixed with respect to shell 30 on a medial side 22 thereof, with a remainder of forefoot tongue 46 being free to move or flex with respect to shell 30. Aperture 44 and forefoot tongue 46 are positioned in shell 30 such that forefoot tongue 46 is positioned beneath the first metatarsal head of a user's foot. First aperture 44 increases the flexibility in a forefoot portion 16 of shell 30 of midsole 26, while forefoot tongue 46 provides support for the first metatarsal head of the user's foot.

In certain embodiments, first aperture 44 has a base portion 48 extending substantially parallel to a longitudinal axis L of midsole 26. A first arm 50 extends outwardly from a first forward end 52 of base portion 46 toward medial side 22 of midsole 26. A second arm 54 extends outwardly from a second rear end 56 of base portion 48 toward medial side 22 of midsole 26. In certain embodiments, first arm 50 and second arm 54 are angled outwardly from base portion 48 away from one another.

In certain embodiments, a second aperture 58 is formed in and extends through midfoot portion 18 of midsole 26. Second aperture 58 defines a second midfoot flap or tongue 60 fixed with respect to shell 30 on a lateral side 24 thereof, with a remainder of midfoot tongue 60 being free to move or flex with respect to shell 30. Second aperture 58 and midfoot tongue 60 are positioned in shell 30 such that midfoot tongue 60 is positioned beneath the cuboid bone of a user's foot. Second aperture 58 increases the flexibility in a midfoot portion 18 of shell 30 of midsole 26, while midfoot tongue 60 provides support for the cuboid bone of the user's foot.

In certain embodiments, second aperture 58 has a base portion 62 extending substantially parallel to a longitudinal axis L of midsole 26. A first arm 64 extends outwardly from a first forward end 66 of base portion 62 toward lateral side 24 of shell 30 of midsole 26. A second arm 68 extends outwardly from a second rear end 70 of base portion 62 toward lateral side 24 of shell 30 of midsole 26. In certain embodiments, first arm 64 and second arm 68 are angled outwardly from base portion 62 away from one another.

Figure 6:
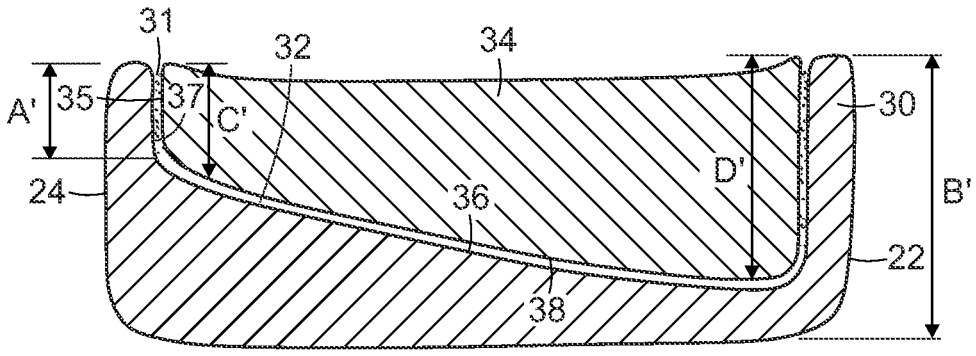
FIG. 6 is a section view of an alternative embodiment of the two-part midsole of FIG. 2.

Another embodiment is illustrated in FIG. 6. In this embodiment, recess 32 has a depth A' on its lateral side 24 and a depth B' on its medial side 22, with depth B' being greater than depth A'. Correspondingly, insert 34 has a height C' on its lateral side 24 and a height D' on its medial side, with height D' being greater than height C'.

As described above in connection with the embodiment shown in FIG. 5, shell 30 has a first hardness, and insert 34 has a second hardness that is different than the first hardness. In the embodiment illustrated in FIG. 6, the second hardness is higher than the first hardness. Thus, shell 30 is softer and compresses more than does insert 34. Since shell 30 is thicker on its lateral side 24 and insert 34 is thinner above the lateral side 24 of shell 30, and shell 30 is thinner on its medial side 22 and insert 34 is thicker above medial side 22 of shell 30, the lateral side 24 of midsole 26 will compress more than its medial side 22 when midsole 26 is compressed by a user's foot. Accordingly, the user's foot is forced to the lateral side 24 of midsole 26 when compressing midsole 26. Thus, the difference in thickness of insert 34 and the difference in the height of recess 32 cooperate to cause midsole 26 to act as a wedge, with more support being provided on medial side 22, thereby helping to reduce pronation.

Figure 7:
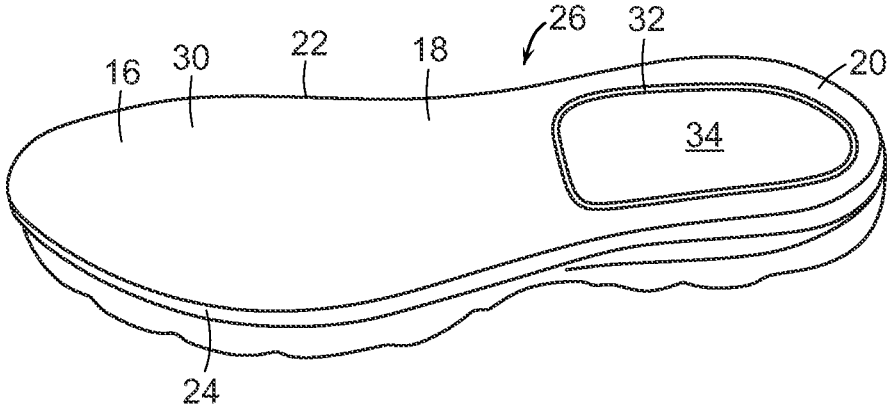
FIG. 7 is a perspective view of another alternative embodiment of a two-part midsole.

In certain embodiments, recess 32 and insert 34 extend along only a portion of sole assembly 14 within shell 30. The remainder of sole assembly 14 in such an embodiment includes a conventional midsole. For example, as illustrated in FIG. 7, recess 32 and insert 34 extend only along heel portion 20 of sole assembly 14, with the remainder of sole assembly including a conventional midsole 26 of unitary construction. It is to be appreciated recess 32 and insert 34 could extend only along other portions of sole assembly 14, such as forefoot portion 16, for example. In other embodiments, a plurality of recesses 32 with corresponding inserts 34 could be positioned along footwear 10, such as in the forefoot portion 16 and heel portion 20, with midfoot portion 18 being of conventional construction. Other suitable variations will become readily apparent to those skilled in the art, given the benefit of this disclosure.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper; and a sole assembly secured to the upper and comprising:

a shell having a first hardness and a recess formed in an upper surface thereof, a lateral side of the recess having a first depth and a medial side of the recess having a second depth that is different than the first depth;

a first aperture extending through a lower surface of the shell and spaced from a lateral side of the shell, the first aperture extending between the recess and an exterior of the shell and defining a first tongue fixed on a medial side thereof, with a remainder of the tongue fee to flex with respect to the shell;

a second aperture extending through a midfoot portion of the shell, the second aperture defining a second tongue fixed on a lateral side thereof with a remainder of the second tongue free to flex with respect to the shell, the second aperture and second tongue being spaced from the first aperture and first tongue; and an insert having a second hardness and seated in the recess, a lateral side of the insert having a first height and a medial side of the insert having a second height that is different than the first height, the second hardness being different than the first hardness.

2. The article of footwear of claim 1, wherein the second depth is less than the first depth.

3. The article of footwear of claim 1, wherein the second height is less than the first height.

4. The article of footwear of claim 1, wherein the second hardness is less than the first hardness.

5. The article of footwear of claim 1, wherein the first aperture comprises:

a base portion having a first end and a second end;

a first arm extending from the first end of the base portion, and a second arm extending from the second end of the base portion.

6. The article of footwear of claim 5, wherein the first and second arms are angled away from one another.

7. The article of footwear of claim 1, wherein the first hardness is between approximately 50 and approximately 70 Asker C.

8. The article of footwear of claim 1, wherein the insert is secured within the recess with an adhesive.

9. The article of footwear of claim 8, wherein the adhesive is positioned solely between a sidewall of the recess and an outer periphery of the insert, a lower surface of the insert being free to move with respect to a lower surface of the recess.

10. The article of footwear of claim 1, wherein the second tongue is positioned to be beneath a cuboid bone of a user's foot.

11. The article of footwear of claim 1, wherein the second aperture comprises:

a base portion having a first end and a second end;

a first arm extending from the first end of the base portion, and a second arm extending from the second end of the base portion.

12. The article of footwear of claim 11, wherein the first and second arms are angled away from one another.

13. The article of footwear of claim 1, wherein the shell is formed of EVA.

14. The article of footwear of claim 1, wherein the insert is formed of EVA.

15. The article of footwear of claim 1, wherein the shell and recess extend along only a portion of a length of the sole assembly.

* * * * *